US008266774B1

(12) United States Patent
Doty

(10) Patent No.: US 8,266,774 B1
(45) Date of Patent: Sep. 18, 2012

(54) LEVER ACTION PIPE FLANGE SPREADER

(76) Inventor: Walter M. Doty, Discovery Bay, CA (US)

( * ) Notice: Subject to any disclaimer, the term of this patent is extended or adjusted under 35 U.S.C. 154(b) by 838 days.

(21) Appl. No.: 12/378,735

(22) Filed: Feb. 19, 2009

Related U.S. Application Data

(60) Provisional application No. 61/065,872, filed on Feb. 19, 2008.

(51) Int. Cl.
*B25B 27/14* (2006.01)

(52) U.S. Cl. ..... 29/253; 29/276; 29/257

(58) Field of Classification Search ..... 29/278, 29/237, 238, 239, 253, 257, 276; 269/3, 269/6, 95, 143, 249
See application file for complete search history.

(56) References Cited

U.S. PATENT DOCUMENTS 3,364,555 A * 1/1968 Swink ..... 29/237
4,054,984 A * 10/1977 Ball et al. ..... 29/237
4,068,365 A 1/1978 Brandt et al.
4,172,472 A 10/1979 Parrish
4,198,738 A 4/1980 Wallace
4,257,135 A 3/1981 Moebius
4,662,055 A 5/1987 VanMeter
4,744,132 A 5/1988 Greene et al.
4,757,588 A 7/1988 Churchich
4,893,393 A 1/1990 Marshall
5,228,181 A 7/1993 Ingle
5,343,607 A 9/1994 Southerland, Jr. et al.
6,101,904 A 8/2000 Freitas
6,837,522 B2 1/2005 Elliott
6,893,012 B2 * 5/2005 Wong ..... 269/249
6,929,430 B2 8/2005 Dever

* cited by examiner

*Primary Examiner* — Lee D Wilson
(74) *Attorney, Agent, or Firm* — Montgomery Patent & Design, LLC; Robert C. Montgomery; Joseph Yaksich

(57) ABSTRACT

A mechanical apparatus designed to separate and spread apart pipe flanges used in industrial type piping systems comprising a screw-driven wedge assembly is herein disclosed. The jacking apparatus provides two (2) jaw assemblies which fit between a pair of mated flanges. The jaw assembly is held in place during the prying process by a tethered metal pin which extends through one of the pipe flange bolt holes. A pair of safety restraint straps support the apparatus during use. Once the apparatus has spread apart the flanges, flange gasket material therebetween can be changed as well as other repair, maintenance or modification activities such as inserting an isolation blind. The apparatus is available in multiple sizes to fit various pipe diameters and flange sizes.

11 Claims, 4 Drawing Sheets

LEVER ACTION PIPE FLANGE SPREADER

RELATED APPLICATIONS

The present invention was first described in and claims the benefit of U.S. Provisional Patent No. 61/065,872 filed Feb. 19, 2008, the entire disclosures of which are incorporated herein by reference.

FIELD OF THE INVENTION

The invention relates to a pipe flange spreader for separating and spreading apart adjoined pipe flanges.

BACKGROUND OF THE INVENTION

As anyone who performs a lot of physical work will attest, nothing beats having the proper tool for a job. The proper tool can save time, save money, produce a higher quality job, reduce damage to equipment, and provide for the increased safety of the worker. One (1) field of work commonly found in the industry, particularly in the petrochemical market, is that of piping work. Flanged piping systems are often found in such environments due to their suitability in high pressure environments, hazardous area usage, and ease of design, installation and repair. In such systems, the flanged joints often have gasketing material which may require periodic replacement, repair or inspection during their life cycle. Currently, high cost hydraulic spreaders are used to separate such piping systems for such work. However, in addition to their high cost, such spreaders are dangerous to use due to possible slippage, take much time to put in place, and occupy a great deal of physical space which is often not readily available in tight piping installations. Accordingly, there exists a need for a means by which flanged joints on industrial piping systems can easily be separated without the disadvantages as mentioned above. The development of the apparatus herein described fulfills this need.

The apparatus is a mechanical apparatus intended to separate and spread apart flanges used in industrial type piping systems comprised of a screw-driven wedge spreader assembly. This assembly is similar in style and operation to that of a motor vehicle jack system found on later model cars. The jack system provides two jaw assemblies which fit through the flange face area. The jaw assembly is held in place during the prying process by a metal pin which extends through an adjacent pipe flange fastening hole. A restraint strap and a restraining chain are also provided for safety and for ease of use. Once the apparatus has spread apart a pipe flange joint, gasketing material can be changed, a blind flange can be inserted or other repair, maintenance or modification can take place. To remove the apparatus, the screw is simply loosened thus removing pressure from the jaws allowing for removal. It is envisioned that the apparatus would be made available in multiple sizes to fit all diameters of piping flanges.

Several attempts have been made in the past to overcome these problems and provide a means of safely and effectively joining and separating pipe joints and repairing pipe system fittings particularly using a threaded crank shaft. U.S. Pat. No. 4,054,984, issued in the name of Ball et al., describes a tool for joining a separating plastic pie and fittings comprising a crank shaft and a pair of clamps which secure to the ends of the pipe sections and fittings utilizing a toggle-type linkage to axially move the pipe sections and fittings toward and away from one another. However, unlike the present apparatus, the Ball tool for joining and separating plastic pipe joints is intended to secure pipe sections and axially draw them together for fastening or away from each other depending on the direction the crank shaft is turned.

U.S. Pat. No. 4,068,365, issued in the name of Brandt et al., discloses an improved locking puller device comprising a three (3) pivotally mounted jaws and cam ring which moves the jaws together or apart as the cam ring traverses a threaded rod. However, unlike the present apparatus, the Brandt locking puller device lacks the means of applying a spreading force to an object.

U.S. Pat. No. 4,893,393, issued in the name of Marshall, discloses a pipe fitting assembly tool comprising a pair of clamps having a separate scissor-type handle assembly which draw pipe sections together or apart depending on the movement of the handle assembly. However, unlike the present apparatus, the Marshall pipe fitting assembly tool uses linkages and a lever action to linearly move two (2) clamped sections of pipe for joining.

U.S. Pat. No. 5,343,607, issued in the name of Southerland, Jr. et al., discloses a tool for installing a gasket and a snap ring comprising a shaft, two (2) plates having a spring therebetween, a loading groove for receiving the snap ring, and a shoulder for holding the gasket. However, unlike the present apparatus, the Sutherland gasket and snap ring installation tool is inserted into a pipe section and retains the snap ring and gasket in place while a second pipe section is connected.

Other known prior art for fastening pipe systems and installing fittings include U.S. Pat. Nos. 6,101,904; 6,929,430; and 4,662,055.

While these devices fulfill their respective, particular objectives and appear to disclose various attempts to secure, align, and fasten pipe section and install fittings; none of the prior art particularly discloses a pipe flange spreading apparatus which provides a means of safely and effectively separate and hold apart pipe flanges in industrial systems for gasket repair and replacement. Accordingly, there exists a need for a lever action pipe flange spreader that operates without the disadvantages as described above.

SUMMARY OF THE INVENTION

In view of the foregoing prior art, the present apparatus is contemplated to solve the aforementioned inherent disadvantages and thus it has been observed that there is need for a lever action pipe flange spreader which provides a means to install and repair connection portions of pipe systems.

To achieve the above objectives, it is an objective of the present apparatus to provide a lever action pipe flange spreader which provides a means to spread pipe sections and hold them apart at the pipe flanges in order to install and repair gaskets or other equipment.

A further object of the present apparatus is to provide a lever action pipe flange spreader comprising a an upper jaw assembly, a lower jaw assembly, a spindle assembly, a screw assembly, a first pivot assembly, and a second pivot assembly, a retaining pin, a first retaining strap, and a second retaining strap which provides a means of removably attaching to connected flange fittings of pipe systems and manually separating the flanges in a manner that enables a user to repair or replace mechanical seals or similar equipment.

Yet still another object of the present apparatus is to provide an upper jaw assembly and a lower jaw assembly each comprising three (3) parallel spreader jaws which provide a mechanical spreading force to the pipe flange via each jaw tip of the jaws fitting between opposing faces of the flange.

Yet still another object of the present apparatus is to provide a spindle assembly comprising a spacer and a fulcrum bolt which provides a means of pivoting and spacing to the upper and lower jaw assemblies.

Yet still another object of the present apparatus is to provide a screw assembly comprising a drive portion, a straight shaft portion, a threaded shaft portion, and a clamping collar which provides a means for a tensioning drive of the lever action of the two (2) jaw assemblies.

Yet still another object of the present apparatus is to provide a threaded shaft portion to which the second pivot assembly mechanically engages and provides a means of pivotally driving the lower jaw assembly as the screw assembly is rotated by the user.

Yet still another object of the present apparatus is to provide a straight shaft portion to which the first pivot assembly mechanically engages and provides a means of pivotally driving the upper jaw assembly as the screw assembly is rotated by the user.

Yet still another object of the present apparatus is to provide a drive portion comprising a multi-sided member which provides a surface for a wrench or similar tool to engage in order to forcibly rotate the screw assembly. The rotation of the screw assembly provides a driving force to the first and second pivot assemblies and thus to the upper and lower jaw assemblies either driving the spreader jaws apart or bringing them together.

Yet still another object of the present apparatus is to provide a retaining pin comprising an integral stop collar and a first and a second restraint strap which provides a means of tethering the apparatus to the pipe flange via inserting the retaining pin into an available bolt hole in the flange connector and engaging the retaining pin with the restraint straps.

Yet still another object of the present apparatus is to provide a method for utilizing a lever action pipe flange spreader.

Further objects and advantages of the present apparatus will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
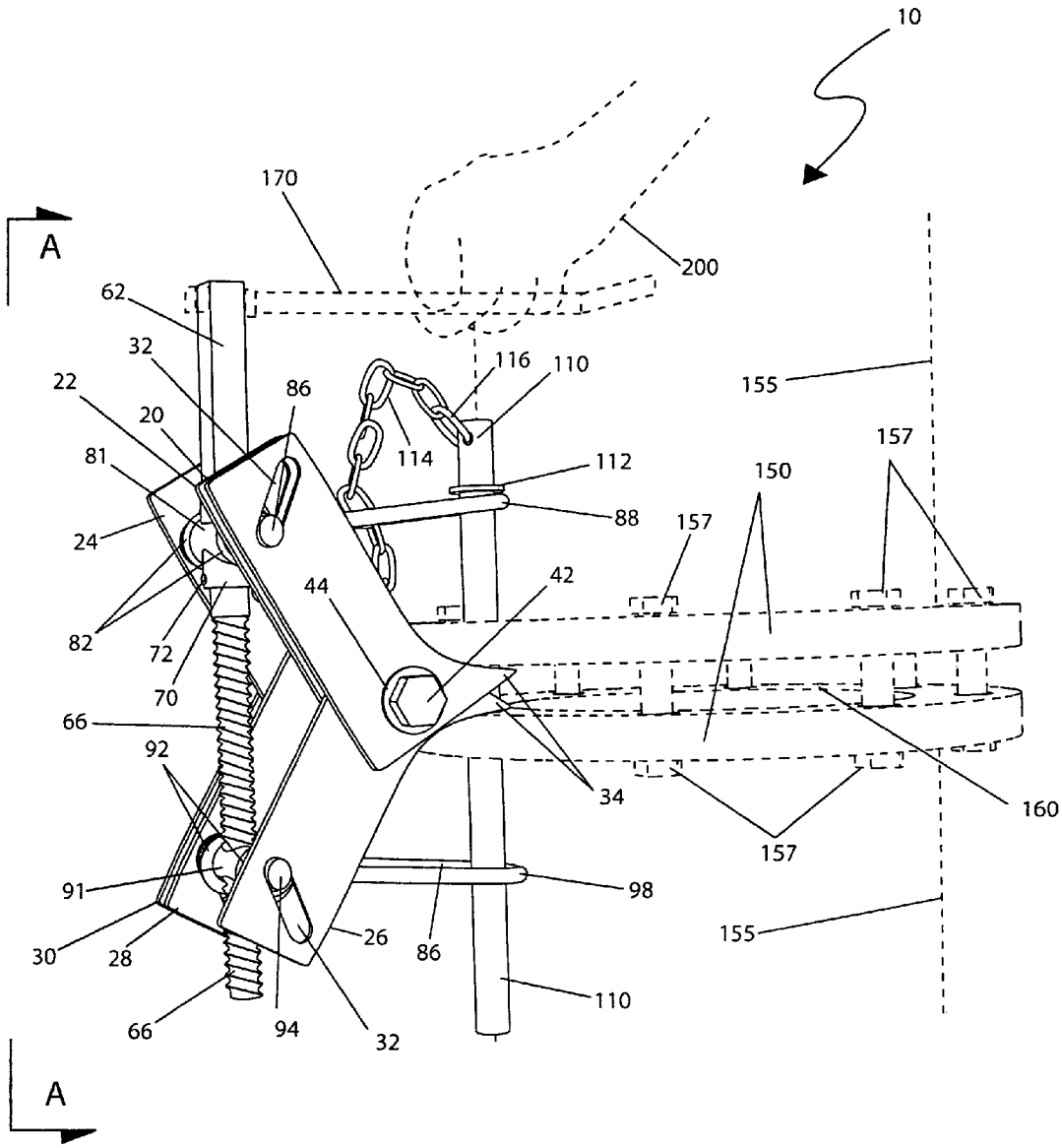
FIG. 1 is an environmental view of a lever action pipe flange spreader 10 depicting an in-use state thereupon a piping assembly, according to a preferred embodiment of the present invention.

| DESCRIPTIVE KEY | |
|---|---|
| 10 | lever action pipe flange spreader |
| 20 | first upper jaw |
| 22 | second upper jaw |
| 24 | third upper jaw |
| 26 | first lower jaw |

-continued

| DESCRIPTIVE KEY | |
|---|---|
| 28 | second lower jaw |
| 30 | third lower jaw |
| 32 | jaw slot |
| 34 | jaw tip |
| 40 | spindle assembly |
| 41 | spacer |
| 42 | fulcrum bolt |
| 44 | washer |
| 60 | screw assembly |
| 62 | drive portion |
| 64 | straight shaft portion |
| 66 | threaded shaft portion |
| 68 | thrust washer |
| 70 | clamping collar |
| 72 | set screw |
| 80 | first pivot assembly |
| 81 | first pivot body |
| 82 | first pivot washer |
| 84 | first pivot short pin |
| 86 | first pivot long pin |
| 88 | first restraint strap |
| 90 | second pivot assembly |
| 91 | second pivot body |
| 92 | second pivot washer |
| 94 | second pivot short pin |
| 96 | second pivot long pin |
| 98 | second restraint strap |
| 110 | retaining pin |
| 112 | stop collar |
| 114 | chain |
| 116 | ring |
| 150 | pipe flange |
| 155 | pipe |
| 157 | flange fastener |
| 160 | gasket |
| 170 | wrench |
| 200 | user |

DETAILED DESCRIPTION OF THE PREFERRED EMBODIMENT

The best mode for carrying out the invention is presented in terms of its preferred embodiment, herein depicted within FIGS. 1 through 3*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a lever action pipe flange spreader (herein described as the "apparatus") 10, providing a means of safely separating and spreading apart pipe flanges 150 used in industrial type piping systems in order to install new or replacement gaskets 160 or other equipment such as isolation blinds mounted therebetween a pair of mating flanges 150. The apparatus 10 provides spreader jaws which fit between the faces of the pipe flanges 150. Application of a separating force thereto the jaws is accomplished via a mechanical screw device in a similar manner to that of a screw-type motor vehicle jacking unit. Once the invention 10 has separated the pipe flanges 150, a gasket 160 may be installed, removed, or replaced. It is envisioned that the apparatus 10 is made using an assembly of high-tensile steel members being plated or painted and made using machining or forging processes common in the industry. It is also envisioned that the apparatus 10 would be introduced in multiple sizes which correspond thereto specific pipe diameters or ranges of pipe diameters.

Referring now to FIG. 1, an environmental view of the apparatus 10 depicting an in-use state thereupon a piping assembly, according to a preferred embodiment of the present invention, is disclosed. The apparatus 10 is a mechanical device providing a separation means thereto a pair of mating piping flanges 150 held together using flange fasteners 157 such as common nuts and bolts. The apparatus 10 provides a removal and replacement means thereto a sealing gasket 160 therebetween said flanges 150. The apparatus 10 comprises a first upper jaw 20, a second upper jaw 22, a third upper jaw 24, a first lower jaw 26, a second lower jaw 28, and a third lower jaw 30. The six (6) jaws 20, 22, 24, 26, 28, 30, are arranged in two (2) offset groupings of three (3), thereby forming parallel pliers-like mechanisms which function in concert therewith one (1) another via a shared fulcrum bolt 42. Said jaws 20, 22, 24, 26, 28, 30 comprise forwardly extending integral pointed tip portions 34 which are inserted therebetween mating pipe flanges 150. The jaws 20, 22, 24, 26, 28, 30 are capable of exerting a separating force thereto said flanges 150 in a similar manner as a pair of snap ring pliers. At a proximal side portion, the first upper jaw 20, second upper jaw 22, and first lower jaw 26 are arranged in a parallel manner with the first lower jaw 26 being sandwiched therebetween and extending therefrom said first 20 and second 22 upper jaw portions at an approximate ninety degree (90°) angle forming a sliding and rotating pliers-like device. Said jaws 20, 22, 26 comprise a shared horizontal fulcrum bolt 42 located thereat a forward portion, thereby providing a mechanical advantage via an elementary lever mechanism. A second grouping of three (3) jaws 28, 30, 24 is arranged in like manner therealong a distal side portion of the apparatus 10 being parallel thereto the previously described jaws 20, 22, 26. The fulcrum bolt 42 provides a shared axle function by extending therebetween the two (2) jaw groupings in a perpendicular manner. The physical gap therebetween the groupings of jaws is maintained via a cylindrical spacer 41 (see FIG. 3*a*). The two (2) offset groupings of jaws 20, 24, 26, 28, 30 provide sufficient force to separate the pipe flanges 150 as shown here. Finally, the jaws 20, 24, 26, 28, 30 each comprise an ovular-shaped jaw slot 32 providing mechanical engagement thereof a first pivot assembly 80 and a second pivot assembly 90 (see FIG. 3*a*).

Figure 2:
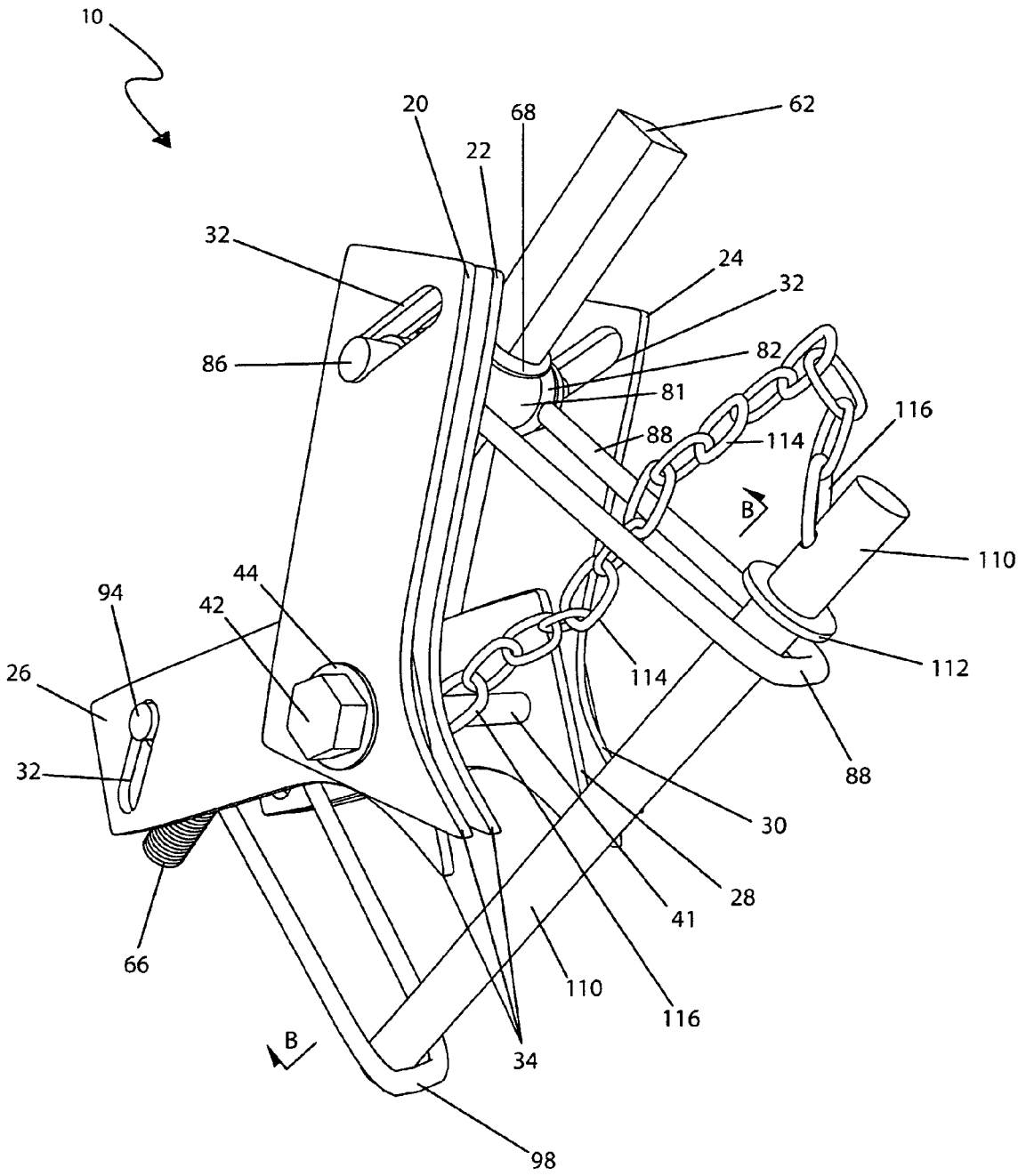
FIG. 2 is a frontal perspective view of the lever action pipe flange spreader 10, according to a preferred embodiment of the present invention.

Referring now to FIG. 2, a frontal perspective view of the lever action pipe flange spreader 10, according to a preferred embodiment of the present invention, is disclosed. The apparatus 10 further comprises a spacer 41, a pair of rings 116, a length of light-duty chain 114, a first restraint strap 88, a second restraint strap 98, and a retaining pin 110. Upon insertion of the flange spreader jaws 20, 22, 24, 26, 28, 30 therebetween the faces of adjacent pipe flanges 150, the apparatus 10 is held in place during the prying process by the restraint straps 88, 98 and the retaining pin 110. The retaining pin 110 comprises a metal rod approximately one-half (½) inch in diameter and twelve (12) inches long and further comprising an integral stop collar 112 positioned adjacent thereto a top portion and designed to support said retaining pin 110 when inserted thereinto a bolt hole portion of the pipe flange 150. The retaining pin 110 further provides an attachment means thereto a length of chain 114 via a common ring fastener 116 and a corresponding through-hole, thereby providing tethering of said retaining pin 110 thereto the apparatus 10. The restraint straps 88, 98 comprise "U"-shaped fixtures made of steel rod stock being affixed thereto the first pivot assembly 80 and second pivot assembly 90, respectively (see FIG. 3*b*). The restraint straps 88, 98 comprise a particular length so as to position a valley portion of the "U"-shaped restraint straps 88, 98 over a vacated bolt hole portion of the pipe flange 150. In use, the retaining pin 110 is inserted downwardly therethrough said restraint straps 88, 98 and one (1) bolt hole portion of the pipe flange 150 until contacting the stop collar 112, thereby stabilizing the apparatus 10 during the prying process.

Figure 3A:
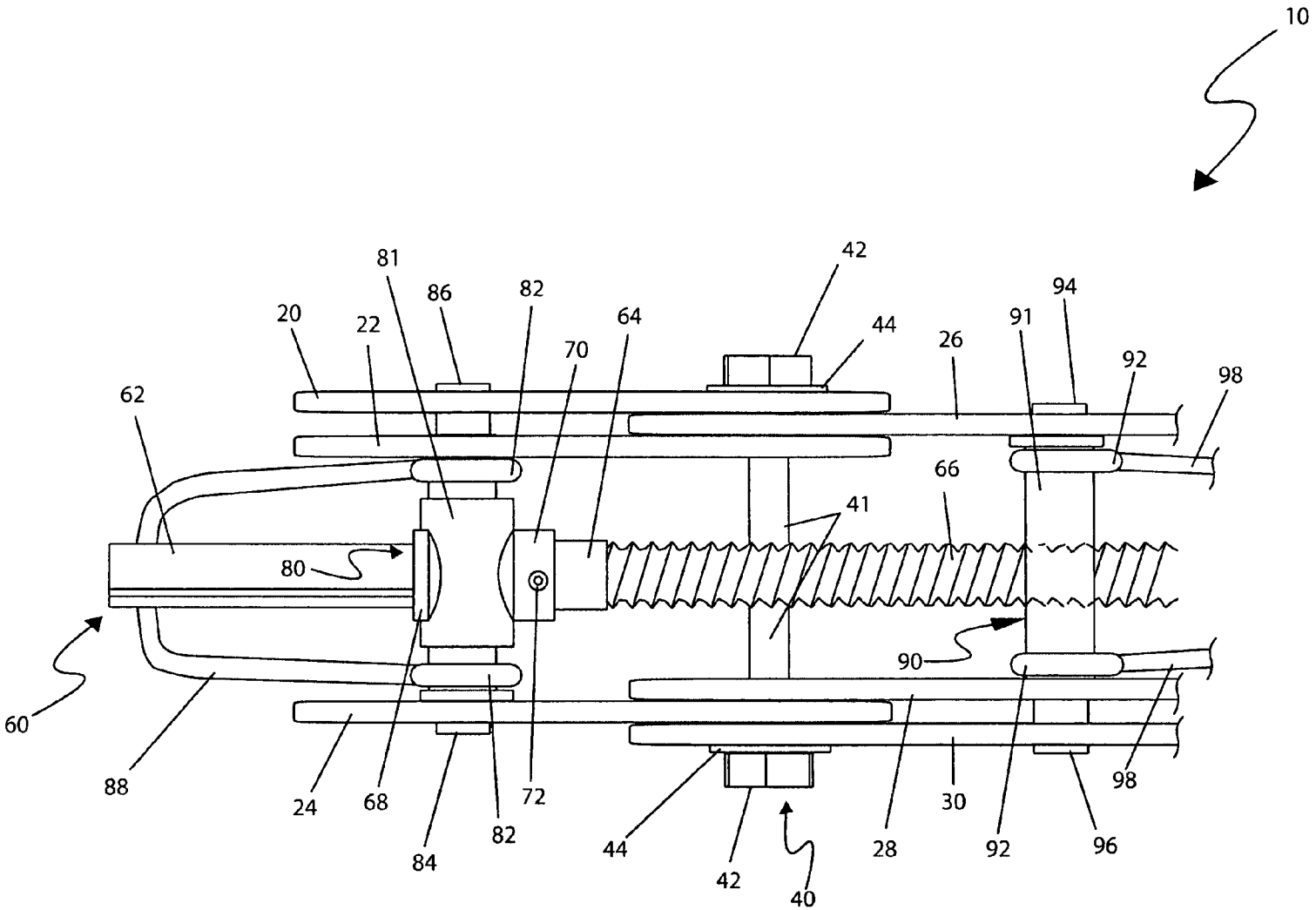
FIG. 3*a* is a section view taken along section line A-A (see FIG. 1) of the lever action pipe flange spreader 10, according to a preferred embodiment of the present invention; and, FIG. 3*b* is a partial section view of a spindle assembly portion 40 taken along section line B-B (see FIG. 2), according to a preferred embodiment of the present invention.

Referring now to FIG. 3*a*, a section view taken along section line A-A (see FIG. 1) of the lever action pipe flange spreader 10, according to a preferred embodiment of the present invention, is disclosed. The apparatus 10 comprises a manually-operated mechanical screw device which functions in a similar manner to that of a screw-type motor vehicle jacking unit. The apparatus 10 provides a tensioning means thereto the spreading jaws 20, 22, 24, 26, 28, 30 comprising a screw assembly 60, a first pivot assembly 80, and a second pivot assembly 90. The screw assembly 60 comprises a one-piece linear shaft comprising machined or forged sections arranged in a series manner along a common axis including a drive portion 62, a straight shaft portion 64, and a threaded shaft portion 66. The drive portion 62 comprises preferably four (4) or six (6) flat sides providing parallel surfaces so as to receive a standard open-end or adjustable wrench 170 to forcibly rotate the screw assembly 60 to spread the jaws 20, 22, 24, 26, 28, 30. The straight shaft portion 64 provides a cylindrical length of shaft approximately three (3) inches long to slidingly receive the first pivot assembly 80 thereupon. Said first pivot assembly 80 is laterally secured thereto the straight shaft portion 64 via a thrust washer 68 along the drive portion 62 side and a common clamping collar 70 and set screw 72 thereat an opposing side surface of said first pivot assembly 80, thereby allowing free rotation of the screw assembly 60 therewithin. The threaded shaft portion 66 comprises a threaded length of shaft approximately one-half (½) inch in diameter and approximately ten (10) inches long. The threaded shaft portion 66 provides a threaded attachment thereto the second pivot assembly 90.

The first pivot assembly 80 further comprises a first pivot body 81, a first pivot short pin 84, and a first pivot long pin 86. The first pivoting assembly 80 provides a rotating attachment means thereat an upper location thereto pivot slot portions 32 of the first upper jaw 20 and second upper jaw 22 via the integral cylindrical-shaped first pivot long pin 86 inserted therethrough. The first pivoting assembly 80 also provides a rotating attachment means along a lower surface thereto the third upper jaw 24 in like manner via the first pivot short pin 84 being inserted therethrough. The second pivot assembly 90 comprises a second pivot body 91, a second pivot short pin 94, and a second pivot long pin 96. The second pivot short pin 94 and second pivot long pin 96 mechanically engage the first lower jaw 26, the second lower jaw 28, and the third lower jaw 30 in like manner as the previously described first pivot assembly 80.

The first 80 and second 90 pivot assemblies also provide an attachment means thereto the aforementioned first 88 and second 98 restraint straps, respectively, Said first 88 and second 98 restraint straps comprise a welded or soldered attachment thereto a first pivot washer portions 82 and a second pivot washer 92, respectively. Said first 82 and second 92 pivot washer portions comprise an inner diameter sized to rotatingly fit thereonto the previously described pivot pins 84, 86, 94, 96. The first 82 and second 92 pivot washers are positioned and secured therebetween the first 81 and second 91 pivot bodies and the respective jaws 20, 22, 24, 26, 28, 30 as shown here.

In use, rotation of the drive portion 62 using a common wrench 170 causes the screw assembly 60 to rotate therewithin said first 80 and second 90 pivot assemblies. The mechanical action of the threaded shaft portion 66 of the screw assembly 60 thereupon the second pivot assembly 90 causes the pivot assemblies 80, 90 to be forced together; the jaws 20, 22, 24, 26, 28, 30 to be spread apart; and consequently the flanges 150 to be pried away therefrom each another (see FIG. 1).

Figure 3B:
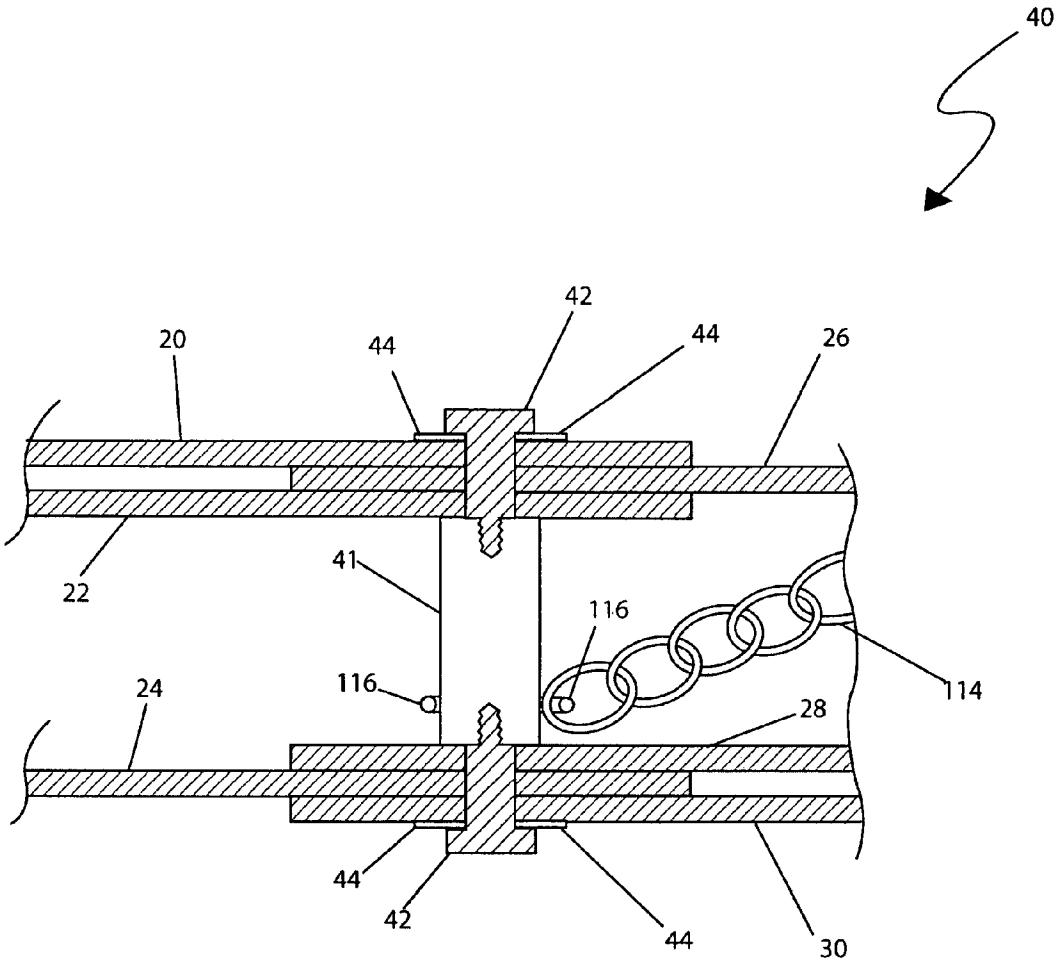

Referring now to FIG. 3*b*, a partial section view of a spindle assembly portion 40 taken along section line B-B (see FIG. 2), according to a preferred embodiment of the present invention, is disclosed. The apparatus 10 comprises a spindle assembly 40 further comprising a spacer 41, a pair of fulcrum bolts 42, and a pair of washers 44. The spindle assembly 40 provides a single combined axial function thereto the rotary motion of the jaws 20, 22, 24, 26, 28, 30. The spacer 41 provides a particular length so as to define a gap therebetween the previously described groupings of spreading jaws 20, 22, 24, 26, 28, 30 (see FIG. 1). The spacer 41 comprises a machined or cast cylindrical steel shape providing a threaded attachment thereto the fulcrum bolts 42 at each end portion. Each fulcrum bolt 42 comprises a shoulder bolt fastener having a particular straight length which when assembled therewith an included washer 44, provides clearance thereto a respective jaw grouping to allow free pivotal motion thereof during the prying process. The spacer 41 further provides an attachment means thereto the aforementioned ring 116 and affixed chain 114 to tether the retaining pin 110 (see FIG. 2).

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: loosening the flange fasteners 157 enough to allow the flanges 150 to be separated; removing one (1) flange fastener 157; adjusting the drive portion 62 of the screw assembly 60 such that the jaw tip portions 34 of the jaws 20, 22, 24, 26, 28, 30 are in alignment; positioning said jaw tip portions 34 therebetween the pair of pipe flanges 150 to be separated; positioning the apparatus 10 thereupon the pipe flanges 150 adjacent thereto the vacated bolt hole portion of the flange 150; positioning the restraint straps 88, 98 on opposing outside surfaces of each pipe flange 150; inserting the retaining pin 110 therethrough the first restraint strap 80, the vacated bolt hole portion of the flange 150, and the second retaining strap 98; adjusting the screw assembly 60 by applying a wrench 170 thereto the drive portion 62 to motion the six (6) jaw tip portions 34 against the pipe flanges 150 until said pipe flanges 150 are sufficiently far enough apart to allow installation or replacement of the gasket 160; removing a required number of remaining flange fasteners 157 so as to provide clearance for the gasket 160; removing and replacing said gasket 160; replacing the previously removed flange fasteners 157; adjusting the drive portion 62 of the screw assembly 60 such that the pipe flanges 150 return thereto a relaxed and contacting state; removing the retaining pin 110 therefrom the restraint straps 88, 98 and vacant hole portion of the flange 150; removing the apparatus 10; installing the remaining flange fastener 157 on the pipe flange 150; tightening all flange fasteners 157 to a specified torque; and, benefiting from safe and timely maintenance of flanged pipe joints 150 using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A pipe flange spreader apparatus, comprising:

an upper jaw grouping comprising:

a first upper jaw comprising a perpendicularly extending jaw tip on a lower end;

a second upper jaw adjacent and parallel to said first upper jaw and comprising a perpendicularly extending jaw tip on a lower end; and, a third upper jaw spaced apart from and parallel to said second upper jaw and comprising a perpendicularly extending jaw tip on a lower end;

a lower jaw grouping pivotably attached to said upper jaw grouping, comprising:

a first lower jaw comprising a perpendicularly extending jaw tip on an upper end;

a second lower jaw adjacent and parallel to said first lower jaw and comprising a perpendicularly extending jaw tip on an upper end; and, a third lower jaw spaced apart from and parallel to said second lower jaw and comprising a perpendicularly extending jaw tip on an upper end;

a horizontal fulcrum bolt pivotably attaching said upper jaw grouping and said lower jaw grouping;

a screw assembly mechanically connected between said upper jaw grouping and said lower jaw grouping for rotating said lower jaw grouping relative to said upper jaw grouping; and, a retaining mechanism adapted to retain said tips of said jaw groupings in engaging contact with a pair of mating piping flanges;

wherein said third upper jaw tip is disposed between said first and second lower jaw tips and said third lower jaw tip is disposed between said first and second upper jaw tips; and, wherein said jaw tips of said upper jaw grouping and said jaw tips of said lower jaw grouping are adapted to engage and exert a separating force upon said pair of mating piping flanges in response to rotation of said lower jaw grouping relative to said upper jaw grouping.

2. The apparatus of claim 1, further comprising a cylindrical spacer spanning a gap between said second upper jaw and said second lower jaw.

3. The apparatus of claim 2, wherein said first upper jaw, said second upper jaw, said first lower jaw, said second lower jaw, said third lower jaw, and said third upper jaw each further comprise a jaw slot.

4. The apparatus of claim 3, wherein said jaw slot comprises an ovular-shape.

5. The apparatus of claim 4, wherein said first pivot assembly further comprises:

a first pivot body comprising a central through hole for receiving said straight shaft portion of said screw assembly;

a first pivot short pin extending from a side of said first pivot body and insertably connected within said jaw slots of said third upper jaw; and, a first pivot long pin extending from an opposing side of said first pivot body and insertably connected within said jaw slots of said first upper jaw and said second upper jaw.

6. The apparatus of claim 4, wherein said second pivot assembly further comprises:

a second pivot body comprising a threaded central through hole for mating with said threaded shaft portion of said screw assembly;

a second pivot short pin extending from a side of said second pivot body and insertably connected within said jaw slots of said first lower jaw; and, a second pivot long pin extending from an opposing side of said second pivot body and insertably connected within said jaw slots of said second lower jaw and said third lower jaw.

7. The apparatus of claim 3, wherein said screw assembly further comprises:

a drive portion adapted to receive a wrench to forcibly rotate said screw assembly;

a straight shaft portion mechanically connected to said upper jaw grouping; and, a threaded shaft portion mechanically connected to said lower jaw grouping.

8. The apparatus of claim 1, further comprising:

a first pivot assembly rotatably attached between said jaw slots of said first upper jaw, said second upper jaw, and said third upper jaw and rigidly coupled to said straight shaft portion of said screw assembly; and, a second pivot assembly rotatably attached between said jaw slots of said second lower jaw, said third lower jaw, and said third lower jaw and threadingly mated to said threaded shaft portion of said screw assembly.

9. The apparatus of claim 8, wherein said retaining mechanism comprises:

an elongated retaining pin adapted for insertion through a pair of aligned fastener apertures of said pair of mating piping flanges;

a length of chain further comprising a first ring connected to said cylindrical spacer and a second ring connected to said retaining pin;

a first restraint strap affixed to said first pivot assembly; and, a second restraint strap affixed to said second pivot assembly;

wherein said retaining pin is inserted downwardly through said first restraint strap and said second restraint strap for retaining said tips of said jaw groupings in engaging contact with said pair of mating piping flanges.

10. The apparatus of claim 9, wherein said retaining pin comprises a metal rod approximately one-half inch in diameter and twelve inches long.

11. The apparatus of claim 9, wherein said retaining pin further comprises an integral stop collar disposed at a top portion for contact with said first retaining strap.

* * * * *